US005934570A

United States Patent [19]

Lambert

[11] Patent Number: 5,934,570

[45] Date of Patent: Aug. 10, 1999

[54] INJECTOR

[75] Inventor: Malcolm David Dick Lambert, Bromley, United Kingdom

[73] Assignee: Lucas Industries, United Kingdom

[21] Appl. No.: 08/976,665

[22] Filed: Nov. 24, 1997

[30] Foreign Application Priority Data

Nov. 26, 1996 [GB] United Kingdom ..... 9624513

[51] Int. Cl.[6] ..... F02M 39/00; F02M 45/00

[52] U.S. Cl. ..... 239/533.3; 239/533.4; 239/533.5; 239/88; 239/90; 239/95

[58] Field of Search ..... 239/88, 90, 91, 239/92, 93, 94, 95, 96, 533.2, 533.3, 533.4, 533.5

[56] References Cited

U.S. PATENT DOCUMENTS

| | | | |
|---|---|---|---|
| 4,096,995 | 6/1978 | Klomp | 239/94 |
| 4,284,049 | 8/1981 | Chmela | 123/467 |
| 4,653,455 | 3/1987 | Eblen et al. | 123/506 |
| 4,928,886 | 5/1990 | Kronberger | 239/533.5 |
| 4,951,631 | 8/1990 | Eckert | 239/95 X |
| 5,125,580 | 6/1992 | Kronberger | 239/533.4 |
| 5,685,483 | 11/1997 | Ganser | 239/533.9 X |
| 5,709,341 | 1/1998 | Graves | 239/92 |

FOREIGN PATENT DOCUMENTS

| | | |
|---|---|---|
| 0736687 A2 | 10/1996 | European Pat. Off. . |
| 3912834 A1 | 4/1990 | Germany . |
| 57-169877 | 9/1982 | Japan . |

*Primary Examiner*—Andres Kashnikow
*Assistant Examiner*—Robin O. Evans
*Attorney, Agent, or Firm*—Michael Best & Friedrich LLP

[57] ABSTRACT

An injector is described which comprises a valve needle engageable with a seating and biased towards the seating by a spring. The spring is located within a spring chamber and engages a moveable stop. The spring chamber communicates through a restricted passage with a low pressure drain. The injector further includes valve means which, when open, permits fuel to escape from the spring chamber at a higher rate.

9 Claims, 2 Drawing Sheets

INJECTOR

This invention relates to an injector for use in supplying fuel to a cylinder of a compression ignition internal combustion engine. In particular, this invention relates to an injector arranged to supply an initial or pilot injection followed by a main injection.

In order to reduce the levels of combustion noise and emissions produced by a compression ignition engine, it is known to supply an initial pilot injection in which a relatively low quantity of fuel is supplied to the engine, and subsequently supply a main injection, the two injections being separated by a short period of time during which no fuel is injected.

A known injector for use in such a fuel system comprises a valve needle which is biased by a spring into engagement with a seating. The spring engages a moveable stop which is moveable under the influence of a pilot sleeve member. A pilot piston member is located within a bore provided in the pilot sleeve member, the pilot piston member engaging the moveable stop.

The pilot sleeve member is exposed to the pressure within a pump chamber. As the pressure within the pump chamber increases, in use, the pilot sleeve member moves towards the moveable stop, forcing the pilot piston member further into the bore, and pressurizing the fuel therein. The bore of the pilot sleeve communicates with the valve needle, and when the fuel pressure exceeds a predetermined level, the force due to the fuel pressure is sufficient to lift the valve needle from its seating against the action of the spring, and the pilot injection commences. The pilot injection continues until the pilot sleeve member engages the adjustable stop. Such engagement results in the fuel pressurization within the bore terminating, hence continued injection results in the fuel pressure applied to the needle falling.

The fuel pressure within the pump chamber continues increasing, and moves the pilot sleeve member and spring abutment in a direction which compresses the spring. It will be appreciated that the increased compression of the spring returns the needle into engagement with its seating and increases the force necessary to lift the needle from its seating. Continued movement of the pilot sleeve member uncovers a port whereby fuel from the pump chamber is applied to the valve needle. When the fuel pressure applied to the needle is sufficiently high, the needle is lifted from its seating thus commencing the main injection.

The quantity of fuel delivered during the pilot injection is dependent upon a number of factors. In particular, if the fuel pressure at the nozzle prior to the pilot injection is relatively low, a significant amount of the movement of the pilot sleeve member is used to increase the fuel pressure to the nozzle opening pressure, hence relatively little fuel is delivered. If the starting pressure is higher, the pilot injection supplies a greater quantity of fuel. Further, the needle does not tend to lift to its fully lifted position but occupies an intermediate position during pilot injection. In the intermediate position, the needle restricts the flow of fuel and such a restriction may have undesirable effects, in particular causing needle movement. The momentum of the needle may be sufficient to result in the needle remaining lifted from its seating even when the fuel pressure applied thereto has fallen below the gas pressure within the engine cylinder. In such circumstances, gases from the engine cylinder may enter the injector, impairing future operation of the injector.

It is an object of the invention to provide an injector in which the disadvantages described hereinbefore are reduced.

According to the present invention there is provided an injector comprising a valve needle biassed towards a seating by a spring located within a spring chamber, the spring being engaged between a spring abutment associated with the valve needle and a moveable stop, a restricted flow path whereby fuel can flow from the spring chamber at a first restricted rate, and valve means actuable to permit fuel to flow from the spring chamber at a second, higher rate.

It will be appreciated that when the valve means is closed, the restricted flow of fuel from the spring chamber acts, in effect, as a high rate hydraulic spring/dash pot arrangement assisting the spring located within the spring chamber in controlling movement of the valve needle from its seating. Where the injector is a two rate injector, if the valve means is closed for the pilot injection, the rate of opening of the nozzle can be controlled. Subsequent opening of the valve means prior to the main injection allows the main injection to be substantially unaffected by the presence of the valve means.

The valve means is conveniently constituted by a seating defined around an opening communicating with the spring chamber, the moveable stop being engageable with the seating to control fuel flow through the opening.

The invention will further be described, by way of example, with reference to the accompanying drawings, in which.

Figure 1:
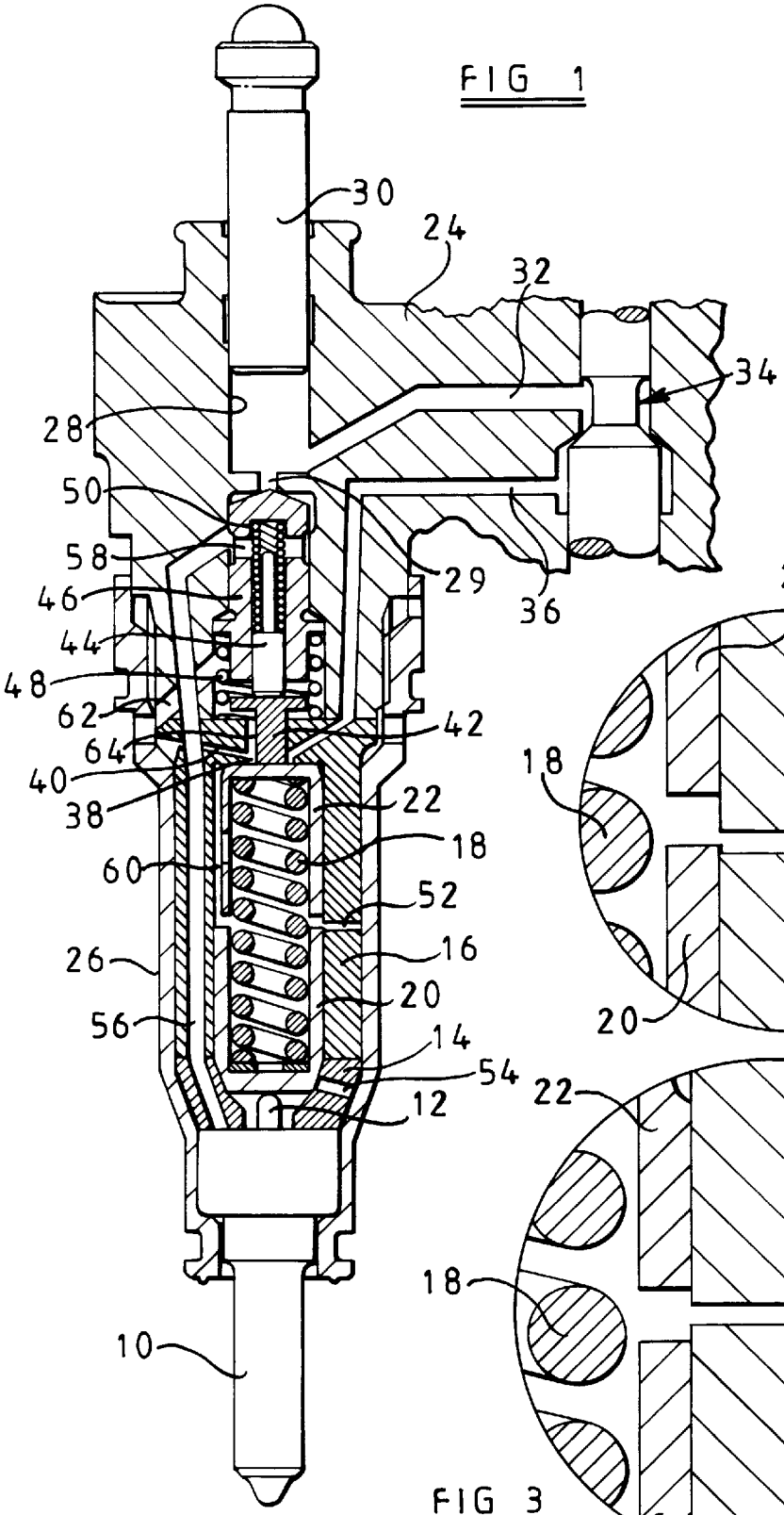
FIG. 1 is a cross-sectional view of a pump/injector in accordance with an embodiment of the invention.

FIG. 1 illustrates a pump/injector arrangement which comprises a nozzle body 10 having a valve needle 12 slidable therein. The valve needle 12 includes thrust surfaces (not shown) which are oriented such that the application of fuel at high pressure thereto urges the valve needle 12 away from a seating defined within the nozzle body 10. The nozzle body 10 abuts a first distance piece 14 which in turn abuts a second distance piece 16. The first and second distance pieces 14, 16 are provided with through bores which define a spring chamber within which a spring 18 is located. The spring 18 is engaged between a spring abutment 20 which engages an end of the valve needle 12, and a moveable stop 22. The moveable stop 22 and spring abutment 20 are both in the form of cup-shaped members.

The second distance piece 16 abuts a pump body 24, a cap nut 26 securing the nozzle body 10, and first and second distance pieces 14, 16 to the pump body 24. The pump body 24 includes a bore 28 within which a plunger 30 is reciprocable under the influence of a cam arrangement (not shown), a return spring (not shown) being arranged to withdraw the plunger 30 from the bore 28. A passage 32 communicates with the bore 28, and supplies fuel to a spill valve arrangement 34 which is arranged to control communication between the passage 32 and a passage 36. The passage 36 communicates with an annular chamber 38 provided within the second distance piece 16 adjacent to an end of the spring chamber, a restricted passage 40 being arranged to connect the annular chamber 38 with a low pressure reservoir.

The moveable stop 22 abuts a second stop 42 which extends into a bore provided in the pump body 24 coaxial with the bore 28. The end of the second stop 42 remote from the moveable stop 22 carries a pilot piston member 44 which is slidable within a bore provided in a pilot sleeve member 46. The pilot sleeve member 46 is biased away from the second stop 42 by a spring 48, and a second, weaker spring 50 is provided within the bore of the pilot sleeve member 46 in order to ensure that the pilot piston member 44 engages the second stop 42. The end of the pilot sleeve member 46 remote from the second stop 42 is arranged to engage a seating defined around a bore 29 connecting the bore 28 to the bore within which the pilot sleeve member 46 is slidable.

The second stop 42 is provided with a channel 64 whereby communication is permitted between the chamber 38 and the bore within which the pilot sleeve member 46 is slidable. A passage 62 connects this bore to the low pressure reservoir.

Figure 2:
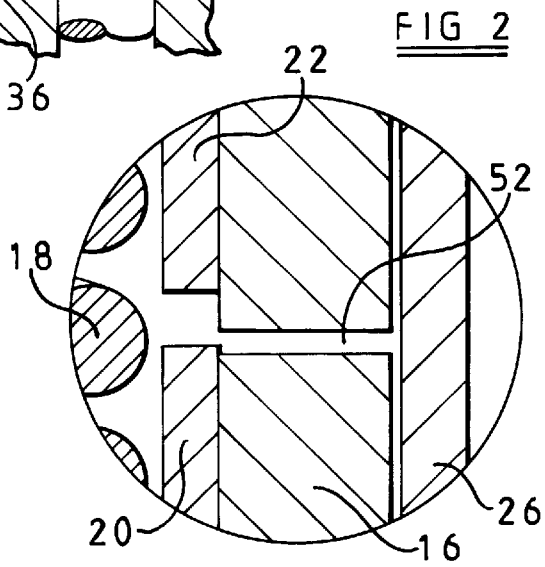
FIG. 2 is an enlarged view of part of FIG. 1.
Figure 3:
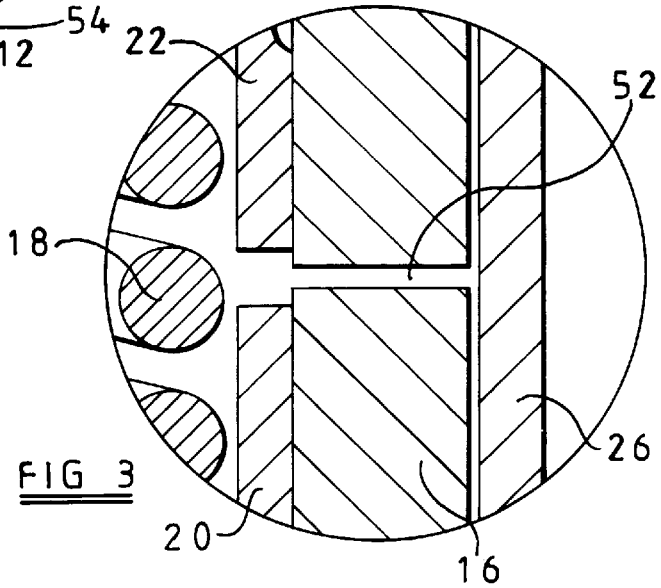
FIG. 3 is a view similar to FIG. 2 of an alternative arrangement.
Figure 4:
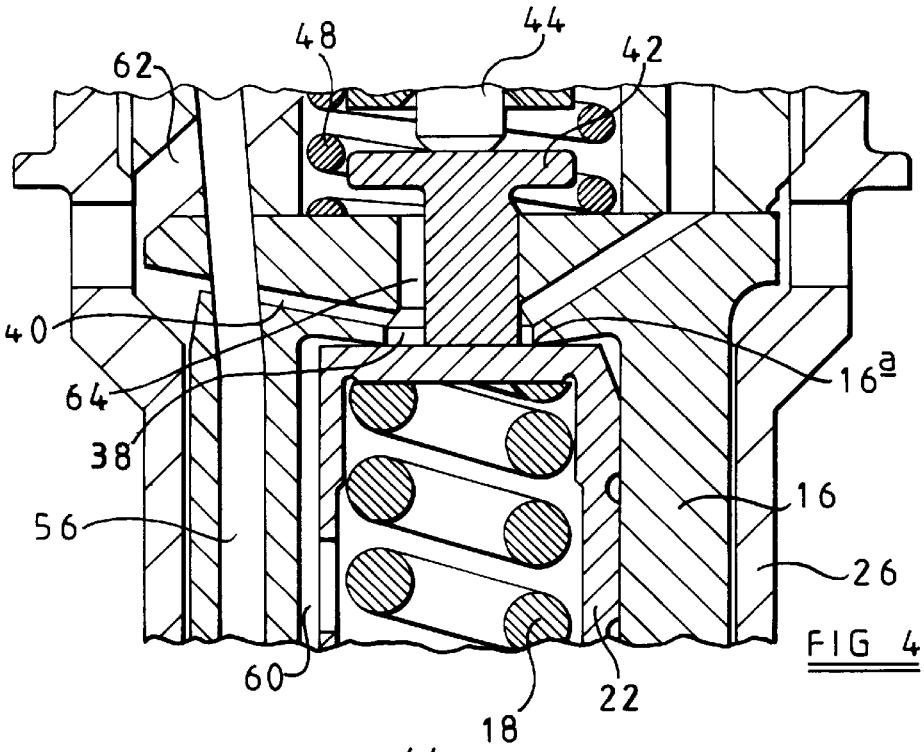
FIGS. 4 and 5 are enlarged views illustrating operation of the pump/injector of FIG. 1.
Figure 5:
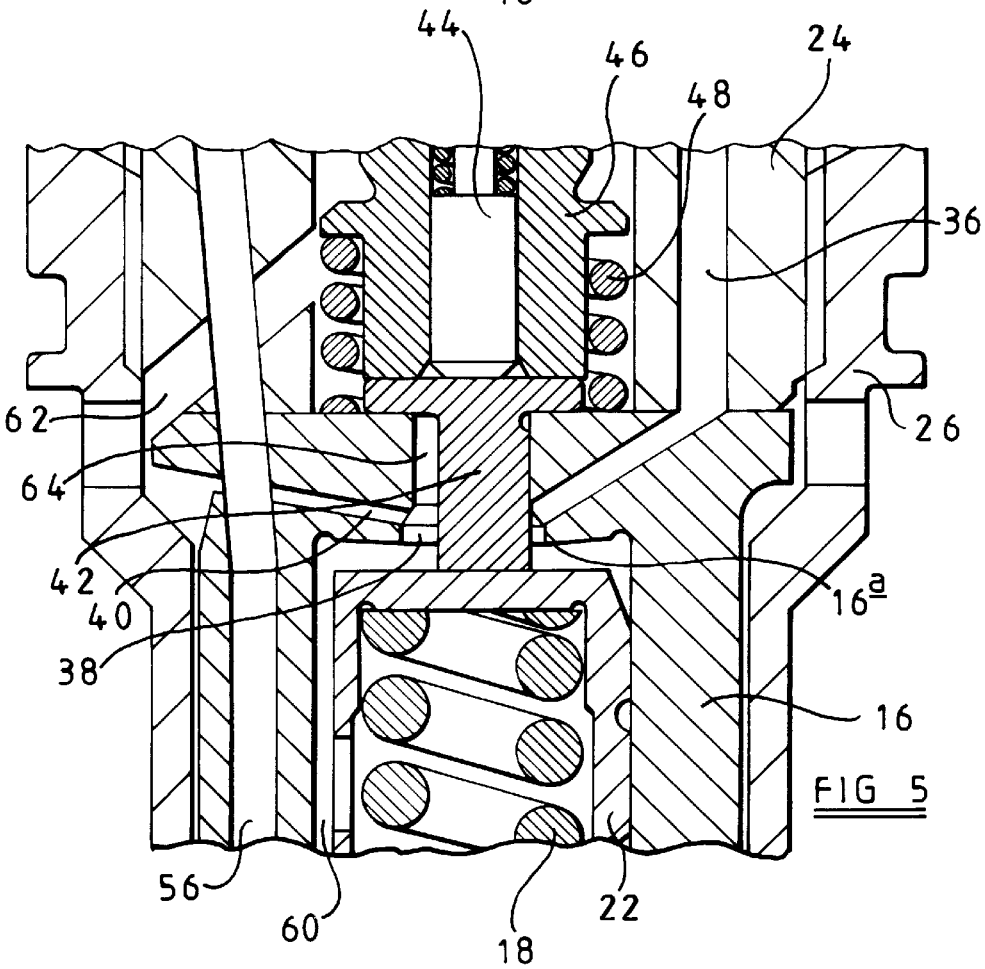

As most clearly shown in FIGS. 4 and 5, the wall of the second distance piece 16 defining the end of the spring chamber is angled so as to define a seating 16*a* with which the moveable stop 22 is engageable in a substantially fluid tight manner. It will be appreciated that when the moveable stop 22 engages the seating, in order to permit movement of the valve needle 12, fuel must be able to escape from the spring chamber. As shown in FIGS. 1, 2 and 3, in order to permit such flow of fuel from the spring chamber, a restricted passage 52 is provided in the second distance piece 16, the restricted passage 52 communicating with the low pressure reservoir. Further, a restricted amount of leakage is permitted through a small, controlled clearance between the spring abutment 20 and the second distance piece 16, such leakage of fuel flowing to the through bore provided in the first distance piece 14, and escaping to the low pressure reservoir through a passage 54 provided therein. In the arrangement illustrated in FIGS. 1 and 2, the restricted passage 52 is located so as to be partially closed by the spring abutment member 20. It will be appreciated that in use, movement of the spring abutment member 20 occurs as the valve needle 12 is lifted from its seating, such movement further obscuring the restricted passage 52. It will be appreciated, therefore, that the rate of fuel flow from the spring chamber is dependent upon the amount of lift of the valve needle 12. In the modification illustrated in FIG. 3, the restricted passage 52 is located so that throughout the range of movement of the valve needle 12, the spring abutment member 20 is spaced from the restricted passage 52 thus the rate of fuel flow through the restricted passage 52 is not dependent upon the position of the valve needle 12 and hence the spring abutment member 20.

A passage 56 is provided in the first and second distance pieces 16, 18 and pump body 24 to permit communication between the thrust surfaces of the valve needle 12 and the bore within which the pilot sleeve member 46 is slidable. In the position shown in FIG. 1, the passage 56 further communicates with the bore of the pilot sleeve member 46 through radially extending drillings 58 provided in the pilot sleeve member 46.

In use, in the position illustrated in FIGS. 1 and 4, the plunger 30 occupies its outer position, and the bore 28 is charged with fuel at relatively low pressure. The pilot sleeve member 46 is in engagement with its seating due to the action of the spring 48, and the spill valve arrangement 34 is positioned so as to permit communication between the passage 32 and the passage 36. The valve needle 12 is in engagement with its seating, and the moveable stop 22 is in engagement with its seating 16*a* due to the action of the spring 18.

Inward movement of the plunger 30 from this position displaces fuel from the bore 28 through the spill valve arrangement 34 to the chamber 38, and from the chamber 38 via the restricted passage 40 to the low pressure reservoir. Subsequently, the spill valve arrangement 34 is actuated to break communication between the passage 32 and the passage 36. After such actuation of the spill valve arrangement 34, continued inward movement of the plunger 30 pressurizes the fuel within the bore 28. The pressurization of the fuel within the bore 28 applies a force to the exposed part of the pilot sleeve member 46, and when the force applied to the pilot sleeve member 46 exceeds the force applied thereto by the spring 48, the pilot sleeve member 48 moves towards the second stop 42. Once such movement commences, fuel at high pressure is applied to the whole of the end area of the pilot sleeve member 46 thus the force applied thereto increases.

The movement of the pilot sleeve member 46 towards the second stop 42 results in the pilot piston member 44 being pushed into the bore of the pilot sleeve member 46 thus pressurizing the fuel within the bore and the fuel within the passage 56. The fuel pressure applied to the valve needle thrust surfaces therefore increases. Once the pressure applied to the thrust surfaces of the valve needle 12 exceeds a predetermined level, the force exerted on the valve needle 12 due to the fuel pressure is sufficient to lift the valve needle 12 against the action of the spring 18. Such movement of the valve needle 12 and spring abutment 20 results in the fuel within the spring chamber being pressurized, thus fuel flows at a restricted rate from the spring chamber through the passage 52 and through the restricted clearance between the spring abutment 20 and the distance piece 16. The relatively slow rate of escape of fuel from the spring chamber limits the rate of movement of the spring abutment 20, and hence the rate of movement of the valve needle 12 away from its seating. By choosing the cross-sectional areas of the passages 52 and the clearance appropriately, additional control of the movement of the valve needle 12 during this part of the injection cycle can be achieved.

As described hereinbefore, in the FIG. 2 arrangement the movement of the valve needle 12 results in the passage 52 being partially obscured thus further restricting the rate at which fuel can escape from the spring chamber.

Continued inward movement of the plunger 30 results in continued movement of the pilot sleeve member 46 until the pilot sleeve member 46 engages the second stop 42. Clearly, the engagement of the pilot sleeve member 46 with the second stop 42 terminates inward movement of the pilot piston member 44, and therefore terminates pressurization of the fuel within the supply line 56. Whilst injection continues, the pressure applied to the thrust surfaces of the valve needle 12 will therefore fall.

The restriction to the flow of fuel from the spring chamber results in the fuel therein compressing. The reduced force acting on the valve needle due to the reduced pressure acting on the thrust surfaces may result in some movement of the needle towards its seating resulting from expansion of the fuel in the spring chamber.

Further inward movement of the plunger 30 causes further movement of the pilot sleeve member 46 against the action of both the spring 48 and the spring 18, the movement of the pilot sleeve member 46 causing movement of both the second stop 42 and the moveable stop 22. Clearly, the movement of the moveable stop 22 increases the compression of the spring 18, and thus applies an increased force to the valve needle 12, and the increased force is sufficient to return the valve needle 12 into engagement with its seating. The movement of the moveable stop 22 further results in the spring chamber being able to communicate with the restricted passage 40 via the chamber 38, and as illustrated in FIGS. 1, 4 and 5, the moveable stop 22 is shaped so as to define a flow passage or channel 60 to permit fuel to flow to the annular chamber 38. The movement of the moveable stop 22 away from its seating 16*a* clearly, therefore, permits fuel flow to or from the spring chamber at an increased rate.

In addition to returning the valve needle 12 to its seating, the increased compression of the spring 18 causes an increase in the force which must be applied to the valve needle 12 in order to lift the valve needle 12 from its seating.

Further movement of the plunger 30 into its bore results in the pilot sleeve member 46 moving to a sufficient extent to permit communication between the bore 28 and the passage 56. The pressurized fuel from the bore 28 is therefore applied directly to the thrust surfaces of the valve needle 12. The continued movement of the plunger 30 will increase the pressure applied to the thrust surfaces to a sufficient extent to cause the valve needle 12 to lift from its seating against the increased force applied thereto by the spring 18. Such lifting of the valve needle 12 permits a second, main injection to occur.

In order to terminate injection, the spill valve arrangement 34 is returned to the position illustrated in FIG. 1. In this position, fuel from the bore 28 and passage 56 is able to flow to the passage 36 and from there through the restricted passage 40 to a suitable low pressure reservoir. Such a flow of fuel reduces the pressure applied to the thrust surfaces of the valve needle thus the valve needle 12 returns into engagement with its seating under the action of the spring 18. In addition, as fuel is able to flow to the spring chamber via the annular chamber 38, the moveable stop 22 being spaced from its seating at this time, fuel at relatively high pressure is applied to the exposed surfaces of the spring abutment 20, the application of fuel at relatively high pressure thereto assisting the action of the spring 18 in returning the valve needle 12 towards its seating.

Continued inward movement of the plunger 30 displaces fuel from the bore 28 past the spill valve arrangement 34 to the low pressure reservoir.

Such displacement continues until the plunger 30 occupies its innermost position, whereafter the plunger 30 commences outward movement under the action of the associated spring. The outward movement of the plunger 30 causes fuel to be drawn from the low pressure reservoir through the restricted passage 40 and through the passages 36 and 32 to the bore 28 to charge the bore 28 with fuel at relatively low pressure. As by this time the second stop 42 has returned to the position shown in FIG. 1, fuel is also able to flow along the passage 62 which communicates with the bore within which the pilot sleeve member 46 is slidable, and through the channel 64 provided in the second stop 42 to the annular chamber 38. This additional flow path increases the rate at which fuel can be supplied to the bore 28. Fuel continues to flow to the bore 28 until the plunger 30 occupies its outermost position ready for commencement of the next injection cycle.

It will be appreciated that during the main injection, as the moveable stop 22 is lifted from its seating, the effect of the provision of the restricted flow path from the spring chamber is negated, thus the injector operates in the same way during this phase of the injection cycle as it would if the invention were not present.

It will be appreciated that the invention is applicable to other types of injector, and should not be restricted to the specific type of injector described hereinbefore.

I claim:

1. An injector comprising a valve needle biassed towards a seating by a spring located within a spring chamber, the spring being engaged between a spring abutment associated with the valve needle and a moveable stop, a restricted flow path whereby fuel can flow from the spring chamber at a restricted rate, and valve means actuable to permit fuel to flow from the spring chamber at a second, higher rate.

2. An injector as claimed in claim 1, wherein the valve means is constituted by a seating defined around an opening communicating with the spring chamber, the moveable stop being engageable with the seating to control fuel flow through the opening.

3. An injector as claimed in claim 1, wherein the moveable stop is moveable under the influence of the fuel pressure within a pump chamber.

4. An injector as claimed in claim 1, wherein the valve means is closed during a pilot injection, fuel being able to escape from the spring chamber at the restricted rate during the pilot injection, the valve means opening prior to commencement of a main injection.

5. An injector as claimed in claim 1, wherein the restricted rate at which fuel can escape from the spring chamber whilst the valve means is closed is variable and dependent upon the position of the valve needle.

6. An injector comprising a valve needle biased towards a seating by a spring located within a spring chamber, the spring being engaged between a spring abutment associated with the valve needle and a moveable stop, a restricted flowpath whereby fuel can flow from the spring chamber at a restricted rate, and valves means actuable to permit fuel to flow from the spring chamber at a second, higher rate, wherein the valve means is constituted by a seating defined around an opening communicating with the spring chamber, and wherein the moveable stop is engageable with the seating to control fuel flow through the opening.

7. An injector comprising a valve needle biased towards a seating by a spring located within a spring chamber, the spring being engaged between a spring abutment associated with the valve needle and a moveable stop, wherein the moveable stop is moveable under the influence of the fuel pressure within a pump chamber, a restricted flow path whereby fuel can flow from the spring chamber at a restricted rate, and valve means actuable to permit fuel to flow from the spring chamber at a second, higher rate.

8. An injector comprising a valve needle biased towards a seating by a spring located within a spring chamber, the spring being engaged between a spring abutment associated with the valve needle and a moveable stop, a restricted flow path whereby fuel can flow from the spring chamber at a restricted rate, and valve means actuable to permit fuel to flow from the spring chamber at a second, higher rate, wherein the valve means is closed during a pilot injection, wherein fuel is able to escape from the spring chamber at the restricted rate during the pilot injection, the valve means opening prior to commencement of a main injection.

9. An injector comprising a valve needle biased towards a seating by a spring located within a spring chamber, the spring being engaged between a spring abutment associated with the valve needle and a moveable stop, a restricted flow path whereby fuel can flow from the spring chamber at a restricted rate, wherein the restricted rate at which fuel can escape from the spring chamber while the valve means is closed is variable and dependant upon the position of the valve needle, and valve means actuable to permit fuel to flow from the spring chamber at a second, higher rate.

* * * * *